US009512798B2

(12) United States Patent
Zeng et al.

(10) Patent No.: US 9,512,798 B2
(45) Date of Patent: Dec. 6, 2016

(54) METHOD AND SYSTEM FOR DIRECT INJECTION NOISE MITIGATION

(71) Applicant: Ford Global Technologies, LLC, Dearborn, MI (US)

(72) Inventors: Paul Zeng, Inkster, MI (US); Vince Paul Solferino, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 214 days.

(21) Appl. No.: 14/271,363

(22) Filed: May 6, 2014

(65) Prior Publication Data

US 2015/0322879 A1 Nov. 12, 2015

(51) Int. Cl.

| | |
|---|---|
| ***F02D 41/08*** | (2006.01) |
| ***F02D 41/30*** | (2006.01) |
| ***F02D 41/06*** | (2006.01) |
| ***F01P 7/08*** | (2006.01) |
| *F02D 41/38* | (2006.01) |

(52) U.S. Cl.

CPC ..... *F02D 41/08* (2013.01); *F01P 7/08* (2013.01); *F02D 41/064* (2013.01); *F02D 41/065* (2013.01); *F02D 41/30* (2013.01); *F02D 41/3094* (2013.01); *F02D 2041/389* (2013.01); *F02D 2200/021* (2013.01); *F02D 2200/0611* (2013.01); *F02D 2200/0802* (2013.01)

(58) Field of Classification Search

CPC ..... F02D 41/30; F02D 41/3011; F02D 41/3017; F02D 41/3094; F02D 2250/28; F02D 41/06; F02D 41/061; F02D 41/062; F02D 41/064; F02D 41/068; F02D 41/08; F02D 41/086; F02D 41/402; F02M 2200/09; F02M 55/04; F02M 69/30; F02N 11/08; F02N 2019/002

USPC ..... 701/103, 112, 113; 123/366, 677–681, 123/685, 453, 456, 491, 544, 575–578, 581, 123/179.1, 179.3, 179.4, 179.7–179.16, 123/FOR. 119, 294, 299, 339.1–339.24; 417/505

See application file for complete search history.

(56) References Cited

U.S. PATENT DOCUMENTS

| | | | | |
|---|---|---|---|---|
| 5,894,832 | A * | 4/1999 | Nogi | F02D 9/10 123/179.15 |
| 6,932,050 | B2 * | 8/2005 | Shibano | F02D 31/005 123/198 D |
| 7,082,926 | B2 * | 8/2006 | Sadakane | F02B 7/02 123/299 |
| 7,137,377 | B2 | 11/2006 | Kerns et al. | |
| 7,159,568 | B1 * | 1/2007 | Lewis | F02D 19/084 123/299 |

(Continued)

FOREIGN PATENT DOCUMENTS

| | | |
|---|---|---|
| EP | 1172542 B1 | 8/2013 |

*Primary Examiner* — Hieu T Vo
*Assistant Examiner* — Carl Staubach
(74) *Attorney, Agent, or Firm* — James Dottavio; Alleman Hall McCoy Russell & Tuttle LLP

(57) ABSTRACT

A method is provided which mitigates the noise of a direct injection system in a port fuel injection and direct fuel injection (PFI-DI) engine and reduces NVH hardware. During a cold-start, the engine idle speed may be increased to mitigate the direct injection noise and during a warm idle, the engine cooling fan may be turned on during a direct injector cleanout cycle to mitigate the direct injection noise. This allows the PFI-DI engine to be run more efficiently without concern of the noise produced by the direct injectors and high pressure pump of the direct injection system.

9 Claims, 8 Drawing Sheets

(56) References Cited

U.S. PATENT DOCUMENTS 7,198,031 B2 * 4/2007 Saito ..... F02D 41/047 123/345
7,373,924 B1 5/2008 Krengel et al.
8,161,945 B2 4/2012 Mueller et al.
8,561,394 B2 * 10/2013 Porten ..... F01N 3/0842 30/280
9,255,541 B2 * 2/2016 Surnilla ..... F02D 41/3094
2003/0127072 A1 * 7/2003 Gmelin ..... F02D 41/06 123/431
2005/0066939 A1 * 3/2005 Shimada ..... F02D 41/0007 123/431
2006/0075992 A1 * 4/2006 Akita ..... F02D 41/3094 123/431
2006/0124424 A1 * 6/2006 Inoue ..... F04D 25/026 192/48.2
2006/0180102 A1 * 8/2006 Braun ..... F01P 7/048 123/41.12
2007/0119392 A1 * 5/2007 Leone ..... F01N 11/00 123/25 C
2007/0119414 A1 * 5/2007 Leone ..... F02D 19/0684 123/295
2009/0133391 A1 * 5/2009 Porten ..... F01N 3/0842 60/303
2011/0097228 A1 4/2011 Tokuo et al.
2011/0162620 A1 * 7/2011 Bidner ..... F02D 41/0025 123/299
2011/0172859 A1 * 7/2011 Sankaran ..... B60L 15/02 701/22
2013/0048748 A1 * 2/2013 Imoehl ..... F02M 61/166 239/5
2013/0098032 A1 * 4/2013 Wade ..... F02D 41/064 60/602
2014/0172275 A1 * 6/2014 Surnilla ..... F02D 41/062 701/104

* cited by examiner

METHOD AND SYSTEM FOR DIRECT INJECTION NOISE MITIGATION

FIELD

The present application relates generally to systems and methods for an internal combustion engine comprising a direct injection system with a high pressure pump to mitigate noise, vibration, and harshness (NVH).

BACKGROUND/SUMMARY

Internal combustion engines with port fuel injection and direct fuel injection (PFI-DI) have many advantages, such as emission performance and engine optimization. At low loads, the use of port fuel injection reduces engine emission, improves fuel vaporization, and reduces pumping losses and fuel consumptions. At high loads, the use of direct fuel injection increases combustion efficiency, improves engine performance, and fuel consumption. Direct fuel injection is also utilized during cold-starts to improve catalyst warm up time. However, operation of the direct injection system produces noises, such as ticking, and under certain operating conditions are noticeable to the occupants of the vehicle, which may cause them concern and/or dissatisfaction.

One approach to mitigate noises produced by operation of the direct injection system is shown by Krengel et al in U.S. Pat. No. 7,373,924. Therein, noise is mitigated by controlling the solenoid valve of the high pressure pump. Specifically, the solenoid valve is disabled under engine operating conditions when the engine noise and the noise, vibration, and harshness (NVH) hardware is not adequate to mitigate the direct injection system noise, such as during engine cold-starts and warm idle conditions. Another example approach to mitigate noises produced by the direct injection system shown by Mueller et al in U.S. Pat. No. 8,161,945 consists of placing an in-line noise filtering device in the direct injection system to reduce the NVH of the system.

However, the inventors have identified potential issues with the above solutions. In the approach of Krengel, direct injection usage is limited. Specifically, by disabling the solenoid valve of the high pressure pump during conditions when the noise from the direct injection system may be heard by the occupants of the vehicle, direct injection cannot be fully utilized to improve overall engine and emission efficiency. In the approach of Mueller, additional NVH hardware, such as an in-line noise filter, takes up more space and increases costs.

The inventors have recognized the above mentioned issues and developed a method for mitigating the noise of the direct injection system. The method comprises, during a first engine start, operating the engine at a first, higher, idle speed while performing direct fuel injection and during a second engine cold-start, operating at a second, lower, idle speed while performing only port fuel injection. Further, during a warmed up idle speed and in response to a direct injector cleanout cycle, with an engine temperature below a temperature at which the cooling fan is activated, activating the cooling fan while performing a cleanout cycle. In this way, the engine may be run more efficiently for combustion and emission by allowing the use of port fuel injection and direct injection under all operating conditions while mitigating the noise of the direct injection system during certain operating conditions.

As an example, a system at a warm idle may need to perform a direct injector cleanout cycle to remove coking on the injector tips. During a warm idle, the engine speed is low and the engine temperature is below a threshold at which the engine cooling fan is run. The noise from the direct injection system may be heard by the vehicle occupants and cause them concern during the cleanout cycle. To mitigate the noise, the engine cooling fan may be turned on at an overlapping period with the direct injection cleanout cycle. The engine cooling fan is a noise occupants are familiar with and operation of the engine cooling fan during a warm idle reduces the noise level of the direct injection system.

In this way, an engine component already present may be advantageously used during selected conditions to mitigate the noise of the direct injection system. By operating the engine cooling fan or changing the engine idle speed, a familiar engine noise is provided which mitigates the direct injection system noise. For example, the engine idle speed may be increased during an engine cold-start when the direct injection is run to improve catalyst warm up time to mitigate direct injection noise. The use of the engine cooling fan or changing the engine idle speed allows for a reduction in NVH hardware, reducing cost of the direct injection system, and allows for the port fuel injection and direct injection (PFI-DI) engine to be run more efficiently.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
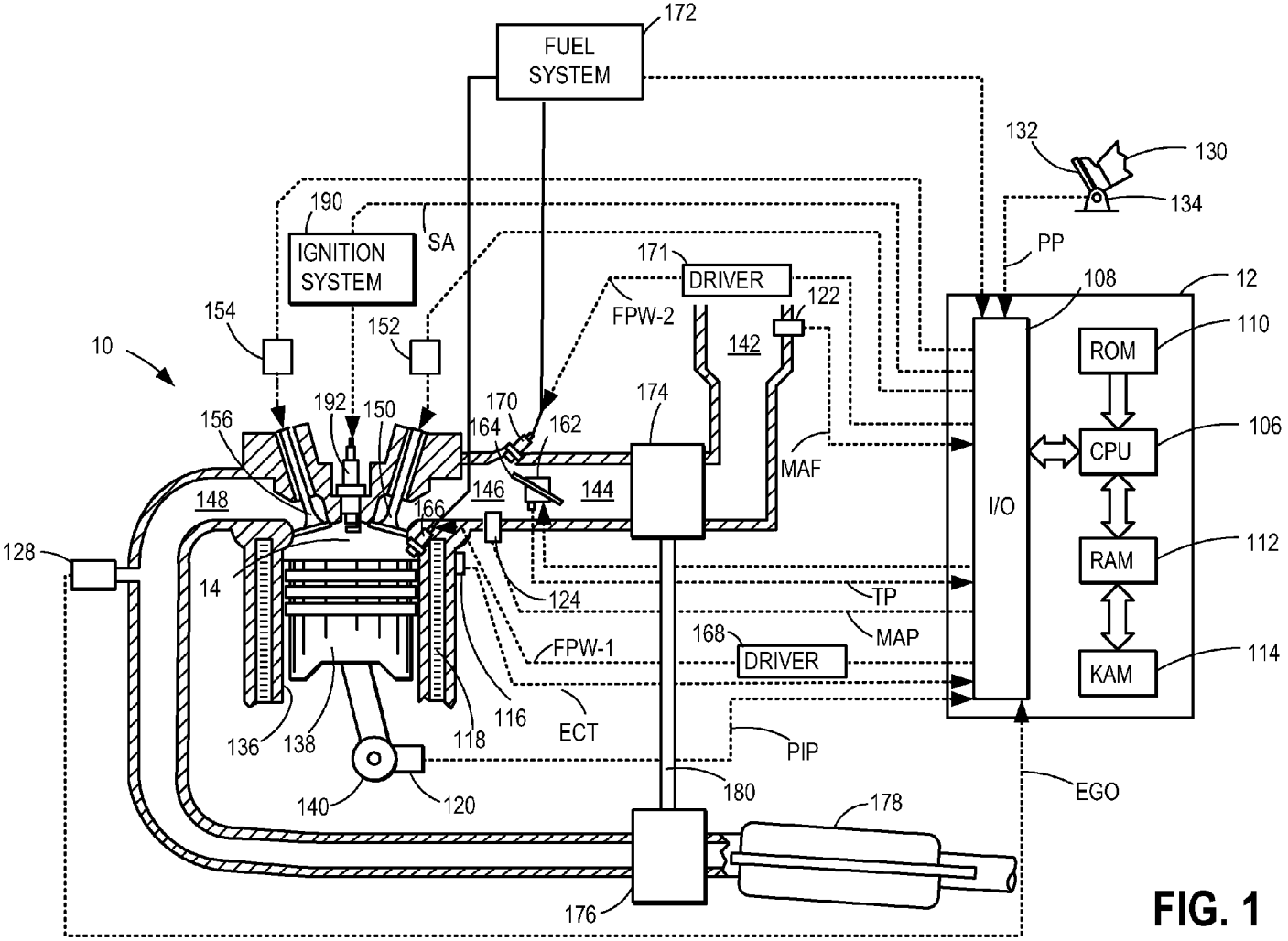
FIG. 1 schematically depicts an example engine cylinder configured with port fuel injection and direct injection.
Figure 2:
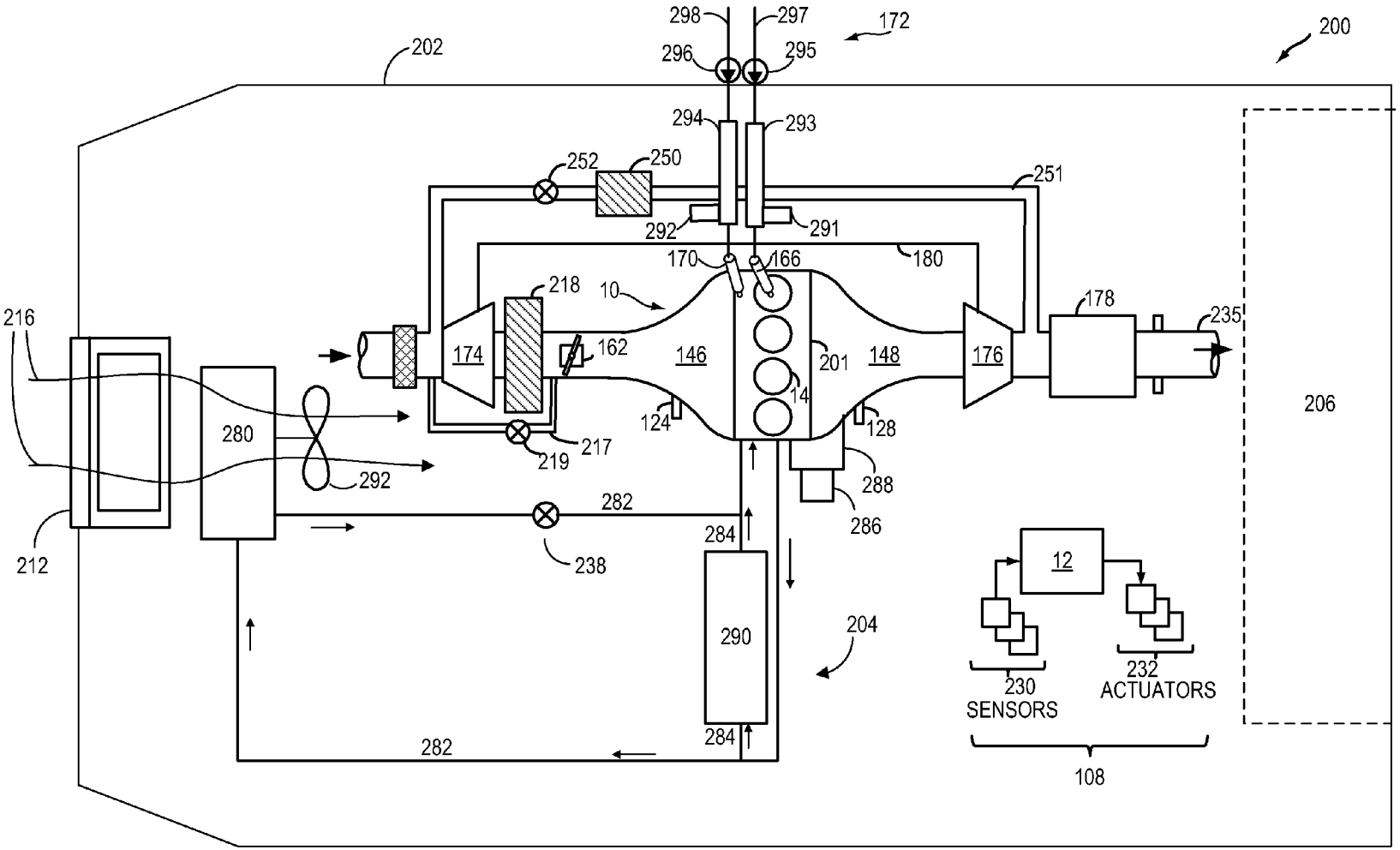
FIG. 2 schematically depicts an example vehicle system including a multi-cylinder engine configured for port fuel injection (PFI) and direct fuel injection (DI).

The present disclosure relates to methods and systems to mitigate the noise of a direct injection system during selected engine operating conditions of an internal combustion engine configured with port fuel injection and direct fuel injection as shown in FIGS. 1 and 2. During selected conditions, when the noise of the direct injection system may be heard by the occupants of the vehicle, a controller may perform a routine, such as the routine of FIGS. 3-7, to mitigate the noise. As such, the high pressure pump attached to the fuel rail and the direct injectors may make a ticking noise that is troublesome to occupants. By operating an engine component, such as an engine cooling fan (FIG. 6), or increasing an engine idle speed (FIG. 7), such as during a cold-start, the NVH issues from the direct injection system components may be mitigated or masked to a level that is no objectionable to the occupants. FIG. 8 illustrates example engine operating scenarios where noise mitigation may be included.

FIG. 1 depicts an example embodiment of a cylinder or combustion chamber of an internal combustion engine 10 including direct fuel injection. Engine 10 may be controlled at least partially by a control system including controller 12 and by input from a vehicle operator 130 via an input device 132. Controller 12 is shown as a microcomputer, including microprocessor unit 106, input/output ports 108, an electronic storage medium for executable programs and calibration values shown as read only memory chip 110 in this example, random access memory 112, keep alive memory 114, and a data bus. In this example, input device 132 includes an accelerator pedal and a pedal position sensor 134 for generating a proportional pedal position signal PP. Cylinder (i.e. combustion chamber) 14 of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system, not shown. Further, a starter motor may be coupled to crankshaft 140 via a flywheel to enable a starting operation of engine 10.

Cylinder 14 can receive intake air via a series of intake air passages 142, 144, and 146. Intake air passage 146 can communicate with other cylinders of engine 10 in addition to cylinder 14. In some embodiments, one or more of the intake passages may include a boosting device such as a turbocharger or a supercharger. For example, FIG. 1 shows engine 10 configured with a turbocharger including a compressor 174 arranged between intake passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 162, including a throttle plate 164, may be provided along an intake passage of the engine for varying the flow rate and/or pressure of intake air provided to the engine cylinders. For example, throttle 162 may be disposed downstream of compressor 174 as shown in FIG. 1, or be provided upstream of compressor 174.

Exhaust passage 148 can receive exhaust gases from other cylinders of engine 10 in addition to cylinder 14. Exhaust gas sensor 128 is shown coupled to exhaust passage 148 upstream of emission control device 178. Sensor 128 may be any suitable sensor for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor. Emission control device 178 may be a three way catalyst (TWC), NOx trap, various other emission control devices, or combinations thereof.

Each cylinder of engine 10 may include one or more intake valves and one or more exhaust valves. For example, cylinder 14 is shown including at least one intake valve 150 and at least one exhaust valve 156 located at an upper region of cylinder 14. In this example, the intake valve 150 and exhaust valve 156 are illustrated as poppet valves. In some embodiments, each cylinder of engine 10, including cylinder 14, may include at least two intake poppet valves and at least two exhaust poppet valves located at an upper region of the cylinder.

Intake valve 150 may be controlled by controller 12 via actuator 152. Similarly, exhaust valve 156 may be controlled by controller 12 via actuator 154. During some conditions, controller 12 may vary the signals provided to actuators 152 and 154 to control the opening and closing of the respective intake and exhaust valves. The position of intake valve 150 and exhaust valve 156 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), and variable valve timing (VVT) and/or variable valve lift (VVL) systems that may be operated by controller 12 to vary valve operation. For example, cylinder 14 may alternatively include an intake valve controlled via electric valve actuation and an exhaust valve controlled via cam actuation including CPS and/or VCT. In other embodiments, the intake and exhaust valves may be controlled by a common valve actuator or actuation system, or a variable valve timing actuator or actuation system.

Cylinder 14 can have a compression ratio, which is the ratio of volumes when piston 138 is at bottom center to top center. Conventionally, the compression ratio is in the range of 9:1 to 10:1. However, in some examples where different fuels are used, the compression ratio may be increased. This may happen for example when higher octane fuels or fuels with higher latent enthalpy of vaporization are used. The compression ratio may also be increased if direct injection is used due to its effect on engine knock.

In some embodiments, each cylinder of engine 10 may include a spark plug 192 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel.

In some embodiments, each cylinder of engine 10 may be configured with one or more fuel injectors for providing fuel thereto. As a non-limiting example, cylinder 14 is shown including two fuel injectors 166 and 170. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection of fuel (hereafter also referred to as "DI") into combustion cylinder 14. While FIG. 1 shows injector 166 as a side injector, it may also be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from fuel system 172 including a fuel tank, fuel pumps, a fuel rail, and driver 168. Further, while not shown, the fuel tank may have a pressure transducer providing a signal to controller 12.

As elaborated herein, during selected engine operating conditions, while the direct injection system is active, an objectionable noise (e.g. ticking noise) may be heard in the vehicle cabin, the noise originating from operation of the direct injectors and/or the high pressure pump attached to the direct injection fuel rail. For example, during a cold-start, when the engine speed is below a threshold, the ticking noise may be heard and may cause concern and inconvenience to occupants in the passenger compartment of the vehicle. As elaborated herein, during such condition, an engine idling speed may be raise to better mask the NVH from the direct injection system. As such, the increase in engine idling speed used to mask DI NVH issues may be different from an increase in engine idling speed used responsive to other engine operating conditions, such as for catalyst warming. Additionally or alternatively, a radiator cooling fan may be actively operated outside of its normal operating conditions, to mitigate the NVH issues. FIGS. 3-7 elaborate example methods to mitigate the noise produced by the direct injection system.

Fuel injector 170 is shown arranged in intake passage 146, rather than in cylinder 14, in a configuration that provides what is known as port injection of fuel (hereafter also referred to as "PFI") into the intake port upstream of cylinder 14. Fuel injector 170 may inject fuel in proportion to the pulse width of signal FPW-2 received from controller 12 via electronic driver 171. Fuel may be delivered to fuel injector 170 by fuel system 172.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions such as described herein below. The relative distribution of the total injected fuel among injectors 166 and 170 may be referred to as a first injection ratio. For example, injecting a larger amount of the fuel for a combustion event via (port) injector 170 may be an example of a higher first ratio of port to direct injection, while injecting a larger amount of the fuel for a combustion event via (direct) injector 166 may be a lower first ratio of port to direct injection. Note that these are merely examples of different injection ratios, and various other injection ratios may be used. Additionally, it should be appreciated that port injected fuel may be delivered during an open intake valve event, closed intake valve event (e.g., substantially before an intake stroke, such as during an exhaust stroke), as well as during both open and closed intake valve operation.

Similarly, direct injected fuel may be delivered during an intake stroke, as well as partly during a previous exhaust stroke, during the intake stroke, and partly during the compression stroke, for example. Further, the direct injected fuel may be delivered as a single injection or multiple injections. These may include multiple injections during the compression stroke, multiple injections during the intake stroke or a combination of some direct injections during the compression stroke and some during the intake stroke. When multiple direct injections are performed, the relative distribution of the total directed injected fuel between an intake stroke (direct) injection and a compression stroke (direct) injection may be referred to as a second injection ratio. For example, injecting a larger amount of the direct injected fuel for a combustion event during an intake stroke may be an example of a higher second ratio of intake stroke direct injection, while injecting a larger amount of the fuel for a combustion event during a compression stroke may be an example of a lower second ratio of intake stroke direct injection. Note that these are merely examples of different injection ratios, and various other injection ratios may be used.

As such, even for a single combustion event, injected fuel may be injected at different timings from a port and direct injector. Furthermore, for a single combustion event, multiple injections of the delivered fuel may be performed per cycle. The multiple injections may be performed during the compression stroke, intake stroke, or any appropriate combination thereof.

As described above, FIG. 1 shows only one cylinder of a multi-cylinder engine. As such each cylinder may similarly include its own set of intake/exhaust valves, fuel injector(s), spark plug, etc.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved.

Fuel system 172 may include one fuel tank or multiple fuel tanks. In embodiments where fuel system 172 includes multiple fuel tanks, the fuel tanks may hold fuel with the same fuel qualities or may hold fuel with different fuel qualities, such as different fuel compositions. These differences may include different alcohol content, different octane, different heat of vaporizations, different fuel blends, and/or combinations thereof etc. In one example, fuels with different alcohol contents could include gasoline, ethanol, methanol, or alcohol blends such as E85 (which is approximately 85% ethanol and 15% gasoline) or M85 (which is approximately 85% methanol and 15% gasoline). Other alcohol containing fuels could be a mixture of alcohol and water, a mixture of alcohol, water and gasoline etc. In some examples, fuel system 172 may include a fuel tank holding a liquid fuel, such as gasoline, and also include a fuel tank holding a gaseous fuel, such as compressed natural gas CNG. Fuel injectors 166 and 170 may be configured to inject fuel from the same fuel tank, from different fuel tanks, from a plurality of the same fuel tanks, or from an overlapping set of fuel tanks.

Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold.

Storage medium read-only memory 110 can be programmed with computer readable data representing instructions executable by processor 106 for performing the methods described below as well as other variants that are anticipated but not specifically listed. Example routines, such as those outlined in FIGS. 3-6, may be performed by the controller.

FIG. 2 shows a schematic diagram of a vehicle system 200 with a multi-cylinder engine system 10 (such as engine system 10 of FIG. 1) coupled in a motor vehicle 202, in accordance with the present disclosure. As depicted in FIG. 1, internal combustion engine 10 includes a controller 12 which receives inputs from a plurality of sensors 230 and sends outputs from a plurality of actuators 232. Engine 10 further includes cylinders 14 coupled to intake passage 146 and exhaust passage 148. Intake passage 146 may include throttle 162. Exhaust passage 148 may include emissions control device 178. Engine 10 is shown as a boosted engine, coupled to a turbocharger with compressor 174 connected to turbine 176 via shaft 180. In one example, the compressor and turbine may be coupled within a twin scroll turbocharger. In another example, the turbocharger may be a variable geometry turbocharger, where turbine geometry is actively varied as a function of engine speed and other operating conditions.

The compressor 174 is coupled through charge air cooler (CAC) 218 to throttle 162. The CAC 218 may be an air-to-air or air-to-water heat exchanger, for example. From the compressor 174, the hot compressed air charge enters the inlet of the CAC 218, cools as it travels through the CAC, and then exits to pass through the throttle valve 162 to the intake manifold 146. Ambient airflow 216 from outside the vehicle may enter engine 10 through a grille 212 at a vehicle front end and pass across the CAC 218 to aid in cooling the charge air. A compressor bypass line 217 with a bypass valve 219 may be positioned between the inlet of the compressor and outlet of the CAC 218. The controller 12 may receive input from compressor inlet sensors such as compressor inlet air temperature, inlet air pressure, etc., and may adjust an amount of boosted aircharge recirculated across the compressor for boost control. For example, the bypass valve may be normally closed to aid in boost development.

Intake passage 146 is coupled to a series of cylinders 14, which may be similar to the cylinder shown in FIG. 1, through a series of intake valves. The cylinders 14 are further coupled to exhaust passage 148 via a series of exhaust valves. In the depicted example, a single intake passage 146 and exhaust passage 148 are shown. In another example, the cylinders may include a plurality of intake passages and exhaust passages to form an intake manifold and exhaust manifold respectively. For example, configurations having a plurality of exhaust passages may enable effluent from different combustion chambers to be directed to different locations in the engine system.

The exhaust from exhaust passage 148 is directed to turbine 176 to drive the turbine. When a reduced turbine torque is desired, some exhaust may be directed through a wastegate (not shown) to bypass the turbine. The combined flow from the turbine and wastegate flows through the emission control device 178. One or more aftertreatment devices may be configured to catalytically treat the exhaust flow, thereby reducing an amount of one or more substances in the exhaust. The treated exhaust may be released into the atmosphere via exhaust conduit 235.

Depending on the operating conditions of the engine, some exhaust gas may be diverted from the exhaust passage downstream of the turbine 176 to an exhaust gas recirculation (EGR) passage 251, through EGR cooler 250 and EGR valve 252 to the inlet of the compressor 174. The EGR passage 251 is depicted as a low pressure (LP) EGR system. In another example, engine 10 may include a higher pressure (HP) EGR system in which exhaust gas is routed from upstream of the turbine to the intake passage downstream of the compressor.

Vehicle 202 further includes a cooling system 204 that circulates coolant through engine 10 to absorb waste heat and distributes the heated coolant to radiator 280 and/or heater core 290 via coolant lines 282 and 284 respectively. In this example, cooling system 204 is shown coupled to engine 10 circulating an engine coolant from engine 10 to radiator 280 via engine-driven water pump 286 and back to the engine via coolant line 282. Engine-drive water pump 286 may be coupled to the engine via front end accessory drive 288 and rotated proportionally to engine speed via belt, chain, etc. The engine-driven water pump 286 circulates coolant through passages in the engine block, head, etc. to absorb engine heat, which is transferred to the radiator 280 then to ambient air. In another example, a motor-controlled pump, which may be adjusted independently of engine rotation, may be used. The temperature of the coolant may be regulated by thermostat valve 238 positioned in cooling line 282. Thermostat valve 238 may be kept closed until the coolant reaches a threshold temperature to aid in engine heating and cooling.

Coolant may flow through coolant line 282 as described above and/or through coolant line 284 to heater core 290, where the heat may be transferred to passenger compartment 206. In some examples, engine-driven water pump 286 may operate to circulate the coolant through both coolant lines 282 and 284.

Engine system 200 may include an engine cooling fan 292 coupled to radiator 280 in order to maintain airflow through radiator 280 when vehicle 202 is moving slowly or stopped while the engine is running when an engine temperature is above a threshold. Fan rotation speed and direction may be controlled by controller 12. Engine cooling fan 292 may be an electric fan. In one example, the engine cooling fan 292 may be coupled to the CAC or placed in a location to direct airflow directly toward the CAC. Further, two or more engine cooling fans may be included in engine system 200 and controlled separately to provide cooling, for example at different rotation speeds.

Vehicle 202 further includes a grille 212 providing an opening, a grille opening, a bumper opening, etc., for receiving ambient airflow 216 through or near the front end of the vehicle and into the engine compartment. Such ambient airflow 216 may then be utilized by radiator 280, engine cooling fan 292, and other components to keep the engine and/or transmission cool. Controller 12 may receive inputs and send outputs to cooling system sensors such as coolant temperature, fan speed, passenger compartment temperature, ambient humidity, etc.

As such, cooling fan 292 may be automatically enabled or activated during conditions when engine cooling is required, such as during hot idling conditions. The inventors herein have recognized that the relatively high noise made by the cooling fan is a noise vehicle occupants may be familiar with and used to. In addition, the high background noise of the cooling fan can mask other objectionable noises such as NVH noises generated during operation of the DI fuel system. As elaborated herein at FIGS. 3-7, during conditions when the cooling fan would otherwise not be operated, such as warm idling conditions, the cooling fan may be selectively enabled for noise mitigation. Specifically, during warm idling conditions when direct injection is enabled, such as for declogging a direct injector tip, the cooling fan may be enabled so that the high background noise of the cooling fan can mask the ticking noise generated by the direct injection system. By synchronizing engine cooling fan operation with direct injector operation, NVH issues associated with the DI system can be masked in a simpler and cost-effective manner.

Engine 10 includes cylinder head 201 shown with four cylinders 14 in an inline configuration. In some examples, cylinder head 201 may have more or fewer cylinders, for example six cylinders. In some examples the cylinders may be arranged in a V configuration or other suitable configuration. Cylinder 14 is shown coupled to fuel injectors 166 and 170 and fuel system 172. Although only one cylinder is depicted coupled to the fuel injectors it is understood that all cylinders included in cylinder head 201 may also be coupled to one or more fuel injectors and the fuel system.

Port fuel injector 170 is connected to a fuel rail 294, which may include a pressure sensor 292. Fuel rail 294 may further be coupled to a fuel line 298, which may be attached to a fuel tank. A pump 296 is shown on fuel line 298. A low pressure pump may be attached to the fuel line for the port fuel injector, for example. Direct fuel injector 166 is connected to fuel rail 293, which may include pressure sensor 291. Fuel rail 293 may be further coupled to fuel line 297, which may be attached to a fuel tank. A pump 295 is shown on fuel line 295. A high pressure pump may be utilized with the direct injector 166, for example. In another example, more than one pump may be included to facilitate fuel delivery and maintain fuel line pressure.

During operation of engine 10, the fuel is injected into the cylinders 14 by means of the fuel distribution rails pressure during opening of the plurality of injection nozzles. The fuel distribution rail pressure is built up by the pump. The delivery of fuel for each combustion event may be done according to a fuel injection profile, by the controller, which may include total fuel injection amount(s), number of injections, injector ratios, injection timing, etc.

Figure 3:
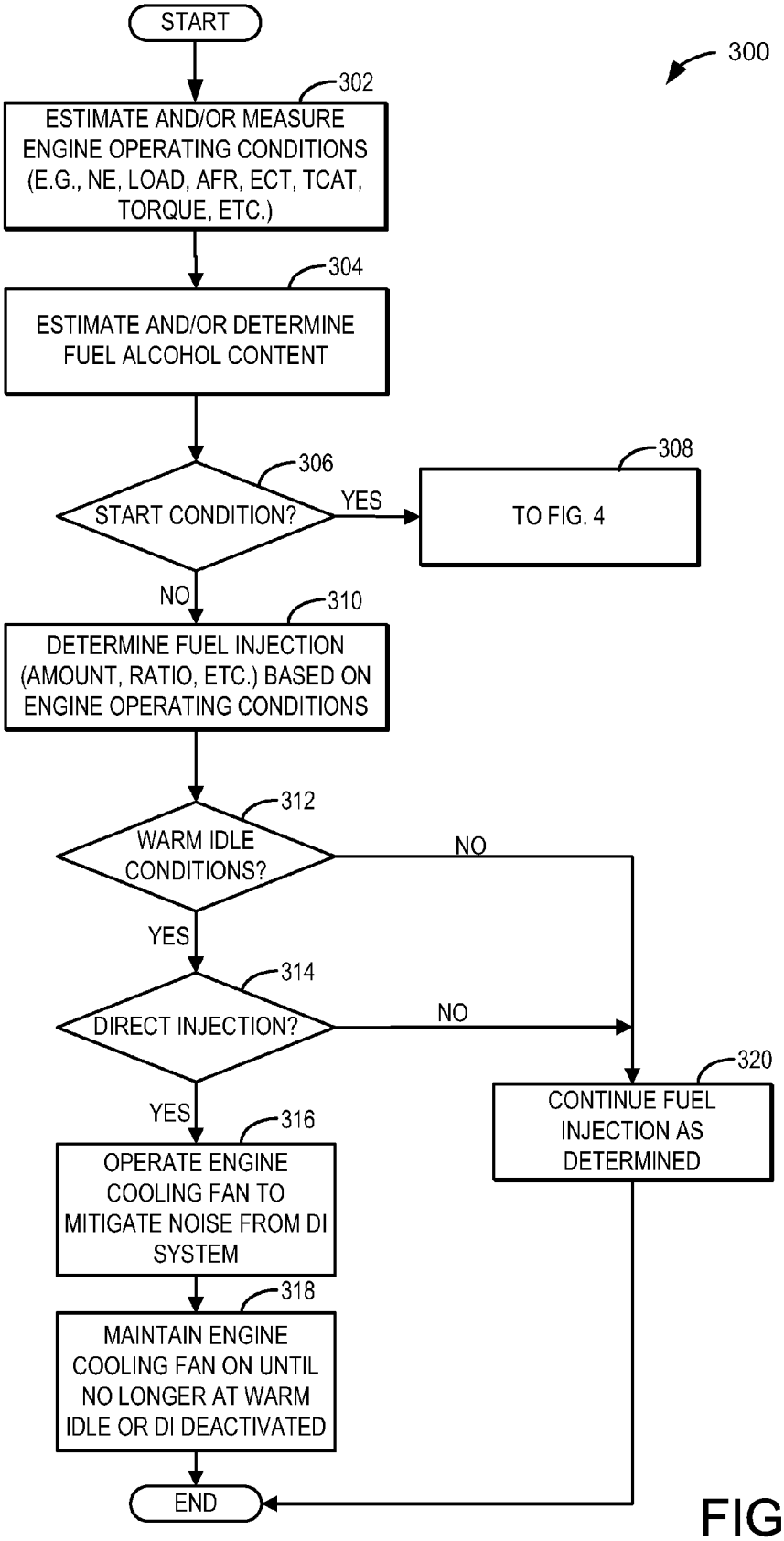
FIG. 3 shows an example method for operating a PFI-DI engine with noise mitigation.
Figure 4:
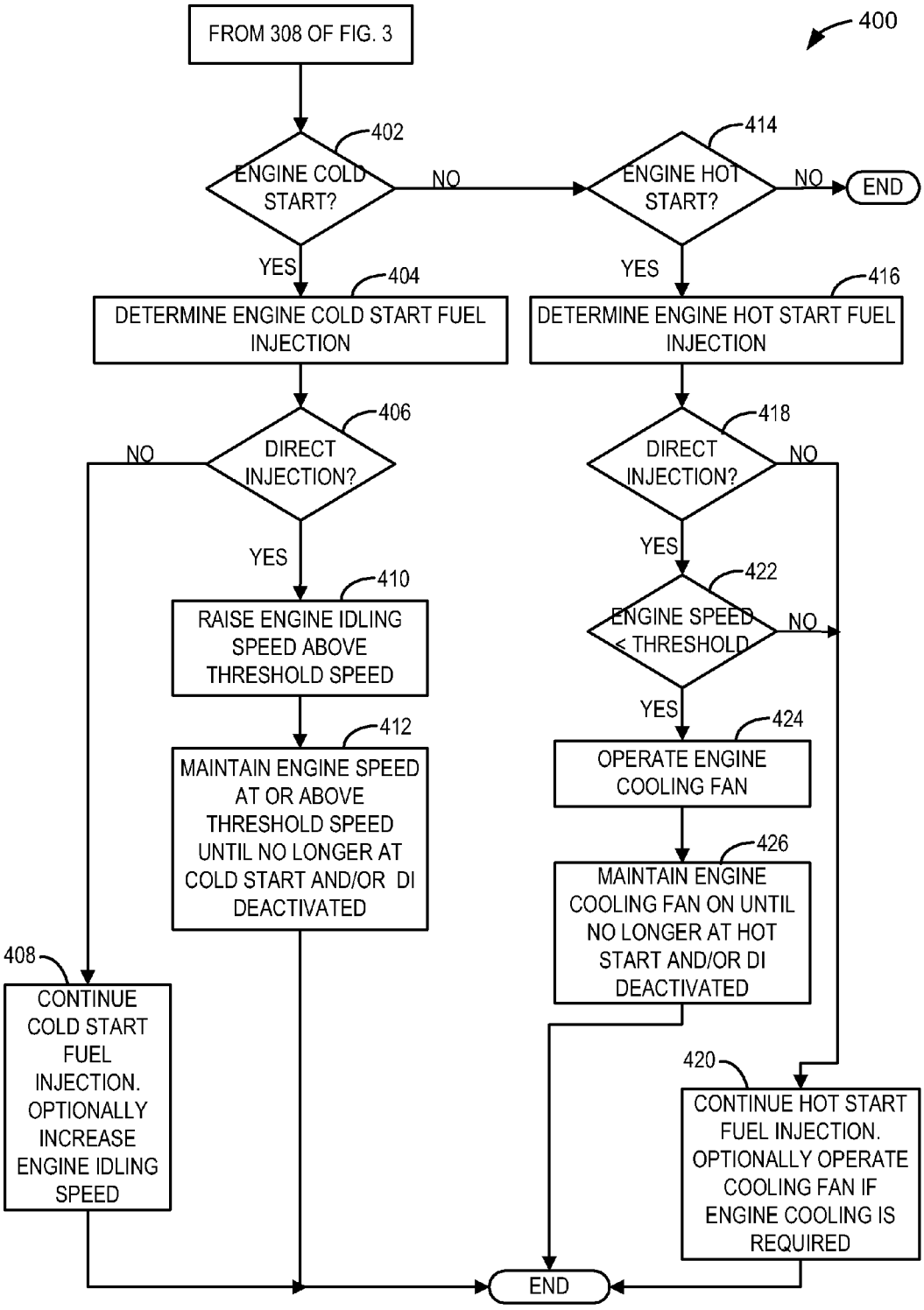
FIG. 4 shows an example method for noise mitigation in a PFI-DI configured engine.

Turning now to FIGS. 3 and 4, example routines 300 and 400 are shown to operate an engine with port fuel injection and direct injection based on engine operating conditions including steps to mitigate the noise of the direct injection system under selected operating conditions. For example, the DI system noise may be mitigated during warm idle conditions when engine speed is low and engine temperature is below a threshold.

At 302, the engine operating conditions may be estimated and/or measured. These may include, for example, engine speed (Ne), engine load, cylinder air-to-injected fuel ratio (AFR), engine temperature (for example, as inferred from an engine coolant temperature), exhaust catalyst temperature (Tcat), desired torque, boost level, ambient air temperature, barometric pressure (BP), etc.

At 304, the method may estimate and/or determine the alcohol content of the available fuel(s). In one example, the alcohol content of the fuel in the fuel tank may be estimated after each tank refueling event. The estimation may be based on one or more empirical methods and further based on inputs from the vehicle operator. In configurations where the port injector injects a first fuel (with a first alcohol content) and the direct injector injects a second fuel (with a second, different alcohol content), the routine includes estimating the alcohol content of each of the port injected and direct injected fuel.

At 306, it may be determined whether a start condition is present. The start condition may include an engine start from engine rest and while the vehicle is at rest. In one example, the start condition may include engine cold-start conditions, such as where the engine and vehicle component temperatures are at ambient temperature, catalyst temperature is below a light off temperature, etc. In another example, the start condition may include engine hot-start conditions, such as engine and vehicle components being above the ambient temperature, catalyst temperature being within a threshold range of (or above) the light off temperature, etc. In yet another example, the start condition may include an engine restart condition, such as a restart soon after a preceding engine shut-down, or a restart from engine idle-stop conditions. As such, in a start condition, the engine temperature and/or the catalyst temperature may be below a desired threshold. For example, the catalyst temperature may be below a threshold catalyst light-off temperature. If a start condition is confirmed at 306, the method may proceed to 308 and then to FIG. 4 to run example routine 400 for controlling fuel injection to an engine cylinder including a port injector and direct injector during an engine start and mitigate noise of the direct injectors during selected engine operating conditions.

If a start condition is not confirmed at 306, at 310, the method may proceed to determine a fuel injection profile based on the engine operating conditions. The fuel injection profile may include determining an amount and timing of fuel (or fuels) to be injected, as well as a ratio of the injected fuel that is to be delivered though the port injector and the direct injector. In one example, the ratio of a direct injector and port injector fuel amount may be based on engine vacuum demand. This approach enables the charge cooling effect of increased direct injection to be advantageously used to mitigate knock while using the additional pumping work associated with the direct injection for generating additional vacuum. In another example, the direct fuel injection amount may be increased while an amount of port fuel injection is decreased when engine speed, engine load, and/or desired torque increases. Herein, the direct injection of the fuel may provide higher fuel efficiency and higher power output. Additionally, if the direct injected fuel is an alcohol fuel, the direct injection of the fuel may be used to take advantage of the charge cooling properties of the alcohol fuel.

At 312, the method includes determining if warm engine idling conditions are present. Warm engine idling conditions may be confirmed if engine temperature is above a threshold temperature and engine speed is below a threshold speed, for example. If warm idling conditions are not confirmed, the method moves to 320 and delivers fuel as determined previously.

If warm idling conditions are confirmed, at 314, it may be determined if the determined fuel injection profile includes at least some direct injection of fuel. That is, it may be determined if the direct injection system is being activated. As such, port fuel injection may be used at warm idling conditions for most of the time while direct injection is deactivated. However, direct injection may be periodically activated for a short duration to enable direct injector tip declogging. Specifically, the direct injection system may be activated for a short duration to clean the DI injector tip of a clog. However, when the DI fuel injection system is activated, the high pressure fuel pump and direct injectors make significant noise that can be objectionable to vehicle occupants.

Therefore, in response to activation of the direct injection system during warm idling conditions, at 316, an engine cooling fan may be enabled or activated. As such, the engine cooling fan may normally not be operated at the warm idling condition since the engine temperature is below a threshold temperature at which cooling assistance may be needed. Thus, the cooling fan is actively operated during operation of the direct injectors and high pressure pump of the direct injection system to mask the noise generated by the DI system. By synchronizing operating of the engine cooling fan based on operation of the direct injection system, the ticking noise of the direct injection system is better mitigated, improving vehicle occupant drive experience.

The engine cooling fan may be started at a time before the direct injection system for an overlapping time period or the engine cooling fan may be started simultaneously to overlap with the activation of the direct injection system. At 318, the method may maintain the engine cooling fan on until the engine is no longer at warm idle conditions and/or until the direct injection system is deactivated. In one example, during a warm idling condition, the engine cooling fan may be turned on for a duration before the DI system is initiated, operated while the DI system is on, and turned off at a time after the DI system is deactivated in order to mitigate the noise from the DI system. The method may then end.

Now turning to FIG. 4, a method for DI noise mitigation during an engine start condition is described. Herein, the DI noise is masked via adjustments to engine idling speeds.

At 402, the method may determine whether an engine cold-start condition is present. As such, an engine cold-start may include an initial engine start from shutdown where engine temperature is below a threshold and an exhaust catalyst temperature is below a threshold temperature, such as a light-off temperature. Direct injection of fuel may be used during an engine cold-start condition to allow for quicker warm up of the exhaust catalyst.

In response to an engine cold-start condition at 402, the routine includes determining an engine cold-start fuel injection profile to expedite catalyst activation. In one example, operating with the cold-start injection profile includes, during a first combustion event and a number of combustion events since the engine start, providing a higher proportion of direct injected fuel relative to port injected fuel. For example, as a difference between a catalyst temperature and light-off temperature increases, the direct injection amount relative to the port injection amount may be increased. In one example, only direct injection of fuel may be used with no port injection of fuel during the cold-start. After the catalyst temperature is above the threshold temperature, the port injection of fuel may then be increased based on a combustion event number since the engine start/restart condition. In another example, operating with a cold-start injection profile includes, providing a higher ratio of port injected fuel to direct injected fuel. For example, when a difference between a catalyst temperature and light-off temperature is lower than a threshold difference, the port fuel injection amount may be higher than the direct fuel injection amount. Further, only port fuel injection may be used with no direct injection when the engine is started from ambient temperatures.

At 406, the method may determine if the direct injection system will be operated based on the engine cold-start injection profile. As such, the direct injection system may be activated if the cold-start injection profile includes any direct injection of fuel. If the DI system is not being activated, the method may proceed to 408 and continue cold-start fuel injection according to the determined profile. Optionally, engine idling speed may be transiently increased during the fueling to expedite catalyst heating. Adjusting of engine idling speed for catalyst heating is elaborated at FIG. 7.

If the DI system is expected to be activated, the method may proceed to 410, where the engine idling speed is increased to above a threshold speed to enable catalyst heating as well as to mask any ticking noise from operation of the DI system. As such, when the direct injection system is operated during a cold-start and the engine is at a low speed, the noise produced by operating the high pressure pump and direct injectors of the direct injection system become apparent. By increasing the engine speed to above a threshold speed, the occupants of the vehicle may not notice the noise produced by the direct injection system. In addition, the elevated engine idling speed expedites catalyst heating during the cold-start. In one example, the engine speed may be increased to above the threshold before the direct injection system is operated. In another example, increasing the engine speed may be done simultaneously with operation of the direct injection system. Further, as elaborated at FIG. 7, the engine idling speed may be raised to a higher level in response to use of direct injection during the cold-start (as at 410) as compared to use of port injection during the cold-start (as at 408).

At 412, the method may maintain the engine speed at or above the threshold speed until the engine is no longer at a cold-start condition and/or the direct injection system is deactivated. For example, the engine idling speed may be lowered when sufficient catalyst heating has been performed and the catalyst temperature is at or around the light-off temperature. Alternatively, the engine idling speed may be lowered when engine fueling is transitioned from only direct injection to only port injection after a number of combustion events since the engine start. By keeping the engine speed above a threshold speed during a cold-start condition when the direct injection system is active, the noise produced by the direct injection system is mitigated and the catalyst is rapidly activated. The method may then end.

Returning to 402, if an engine cold-start condition is not determined, at 414 an engine hot-start condition may be confirmed. As such, the engine hot-start may include an engine restart wherein the engine is restarted soon after a preceding engine shut down. In one example, an engine hot-start condition may be confirmed if an engine temperature and/or a catalyst temperature is above a threshold. If a hot-start is not confirmed, routine 400 ends.

If at 414 a hot-start is confirmed, routine 400 may operate the engine with a hot-start injection profile which may be determined at 416 based on engine speed and load, fuel alcohol content, and other engine operating conditions. In one example, the routine may include a higher proportion of port injected fuel relative to the cold-start profile to take advantage of the intake valve being hot enough to evaporate fuel injected into the intake port. In another example, only port injection may be used when an engine speed is below a threshold, for example, to take advantage of the better performance and lower emissions of port fuel injection at low engine speed. In yet another example, direct injection of fuel may be used in a higher ratio to port injection to take advantage of its charge cooling properties when engine temperature is above a threshold.

At 418, the method may determine if the direct injection system is being operated. If no, the method may proceed to 420 and continue to deliver fuel as per the determined hot-start profile. Optionally, an engine cooling fan may be concurrently operated if engine cooling is required. If the hot start profile does include direct injection, the method may proceed to 422 and determine if the engine speed is below a threshold. The engine speed below a threshold indicates the engine is at idle and the noise of the direct injection system may be apparent inside the vehicle.

If the engine speed is not below the threshold, the hot-start routine may continue at 420 and the method may end. If the engine speed is below the threshold, the method may proceed to 424 and actively operate the engine cooling fan. For example, during a warm idle condition at a hot-restart condition when the direct injection system is being operated, operating the engine cooling fan may mitigate the noise produced by the direct injectors and high pressure pump. Thus, occupants of the vehicle may show no concern over noise from the direct injection system since the engine fan is operating and produces a sound occupants are used to.

At 426, the method maintains the engine cooling fan on until the engine is no longer at an idle speed and/or the direct injection system deactivated. The method may then end.

Figure 5:
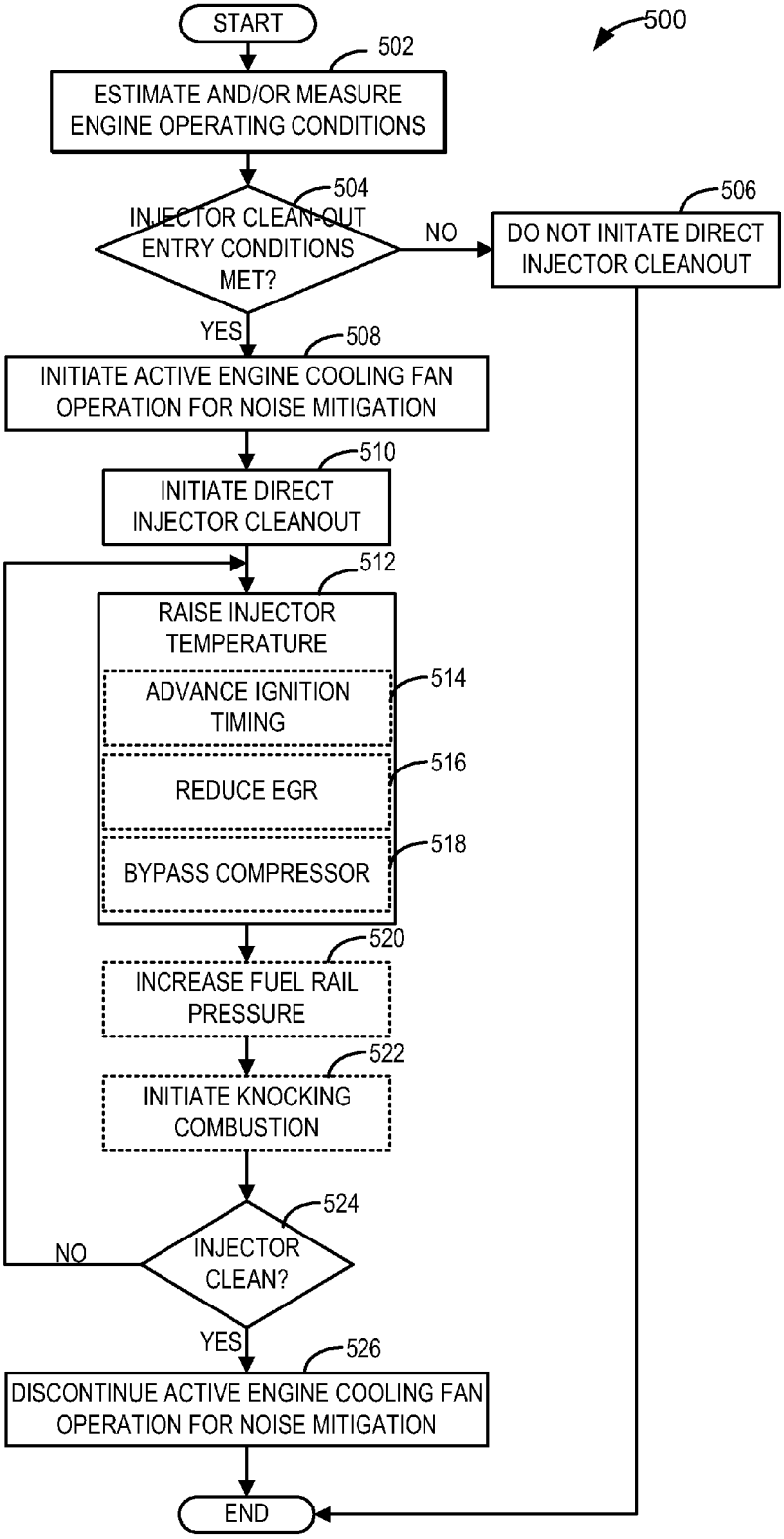
FIG. 5 shows an example method for direct injector maintenance with noise mitigation.

FIG. 5 is a flow chart illustrating a method 500 for mitigating direct injection noise during a direct injector cleanout cycle. The method comprises, during warmed up idle speed, activating an engine cooling fan while operating the DI system to remove coking residues deposited on the direct injectors. The direct injectors may include a catalyst coating to aid in oxidizing particulate matter built up on the injector.

At 502, method 500 includes determining engine operating conditions. The determined engine operating conditions may include: engine speed, engine load, engine temperature, fuel composition, etc.

At 504, it is determined if direct injector cleanout cycle entry conditions have been met. The entry conditions may include an amount of time since the last injector cleaning having elapsed, a particulate load being over a threshold, an engine speed/load being in a mid to low range, and a threshold number of engine cycles and/or miles driven that have elapsed since the last cleaning. The amount of time since the last injector cleaning may be determined as a set time period or be based off of time spent at a warm idle, for example. The particulate load may be estimated based on a model that tracks certain operating parameters, such as speed, load, injector tip temperature, fuel composition, and other parameters, over a duration to determine the amount of particulates expected to have built up on the injector tip. The threshold may be a suitable threshold above which the particulate matter on the injector may clog the injector tip or otherwise cause fueling errors. The engine speeds/loads being high may lead to the temperature in the combustion chamber being high enough to initiate the oxidation of the particulate on the injector, and thus the cleaning routine may be carried out when engine speed and load are low. Further, in other embodiments, the entry conditions may include an amount of time, engine cycles, miles driven, etc. that have lapsed since a previous cleaning routine. As such, any of the entry conditions may be met for entry conditions to be confirmed.

If entry conditions are not met, the method proceeds to 506 and does not initiate the direct injector cleanout cycle. If entry conditions are met, such as an amount of time since the last cleanout cycle has passed and the engine speed is in the mid to low range, the method may proceed to 508 and operate the engine cooling fan. By turning the engine cooling fan on during the direct injector cleanout cycle, the noise from the direct injectors may be mitigated. For example, the engine cooling fan noise may mask the ticking noise of the solenoid valve to a level that is not noticeable to occupants of the vehicle. The direct injector cleanout cycle may be run every twenty minutes, for example, during a warm idle condition and wherein port fuel injection is operated during warm idle.

At 510, the method may initiate the direct injector cleanout cycle by raising the injector temperature at 512 by raising the overall combustion chamber temperature. In one example, a catalyst coating may be included on the injector, at least in some regions, and may oxidize the particulates built up on the injector when the injector temperature is high enough. The overall combustion temperature may be raised by advancing spark timing at 514, reducing EGR at 516, and/or increasing compressor recirculation at 518.

Spark timing may be advanced relative to an optimal setting for the operating conditions, such as maximum brake torque ignition timing, while accounting for additional torque requests, combustion conditions, etc. EGR may be reduced by adjusting the position of one or more EGR valves, such as LP-EGR valve 252, for example, in order to reduce EGR flow into the cylinder. The CAC may be bypassed by operating a bypass valve, such as valve 219, to allow intake air to flow around the CAC to the cylinder through line 217. Other mechanisms for selectively increasing the cylinder temperature may be included, such as adjusting air-fuel ratio.

At 520, the fuel rail pressure may be optionally increased. If increasing the fuel injector temperature is not sufficient to oxidize the particulates, for example if the initial engine temperature is low and the mechanisms to heat the injector tip do not get the injector hot enough to oxidize the particulates, or if operating constraints restrict the ability to raise the injector tip temperature, the particulates may be physically removed from the injector by increasing the pressure at which the fuel exits the injector. Additionally or alternatively, at 522, the engine may be optionally operated with knock combustion to generate pressure waves that may remove the particulates from the injector. Knock combustion may be initiated by interrupting injection of knock control fluids, and/or by adjusting air/fuel ratio, ignition timing, and manifold pressure, or other mechanisms.

At 524, the method may determine if the injector has been fully cleaned. This may be based on a duration and degree of raising the injector temperature, and/or based on the duration and degree of increased fuel pressure and knock combustion. If it is determined the injector has not been fully cleaned, method 500 returns to 512 to continue to raise the injector tip temperature. If the injector has been fully cleaned, the method may proceed to 526 and turn off the engine cooling fan for noise mitigation. In one example, the direct injector cleanout cycle method may be run every 20 minutes and the direct injectors operated for 20 seconds with increased temperature and/or increased fuel rail pressure. During the 20 seconds that the direct injectors are on for the cleanout cycle, the engine cooling fan may also be turned on simultaneously to mitigate the noise of the direct injection system. Method 500 may then end.

Figure 6:
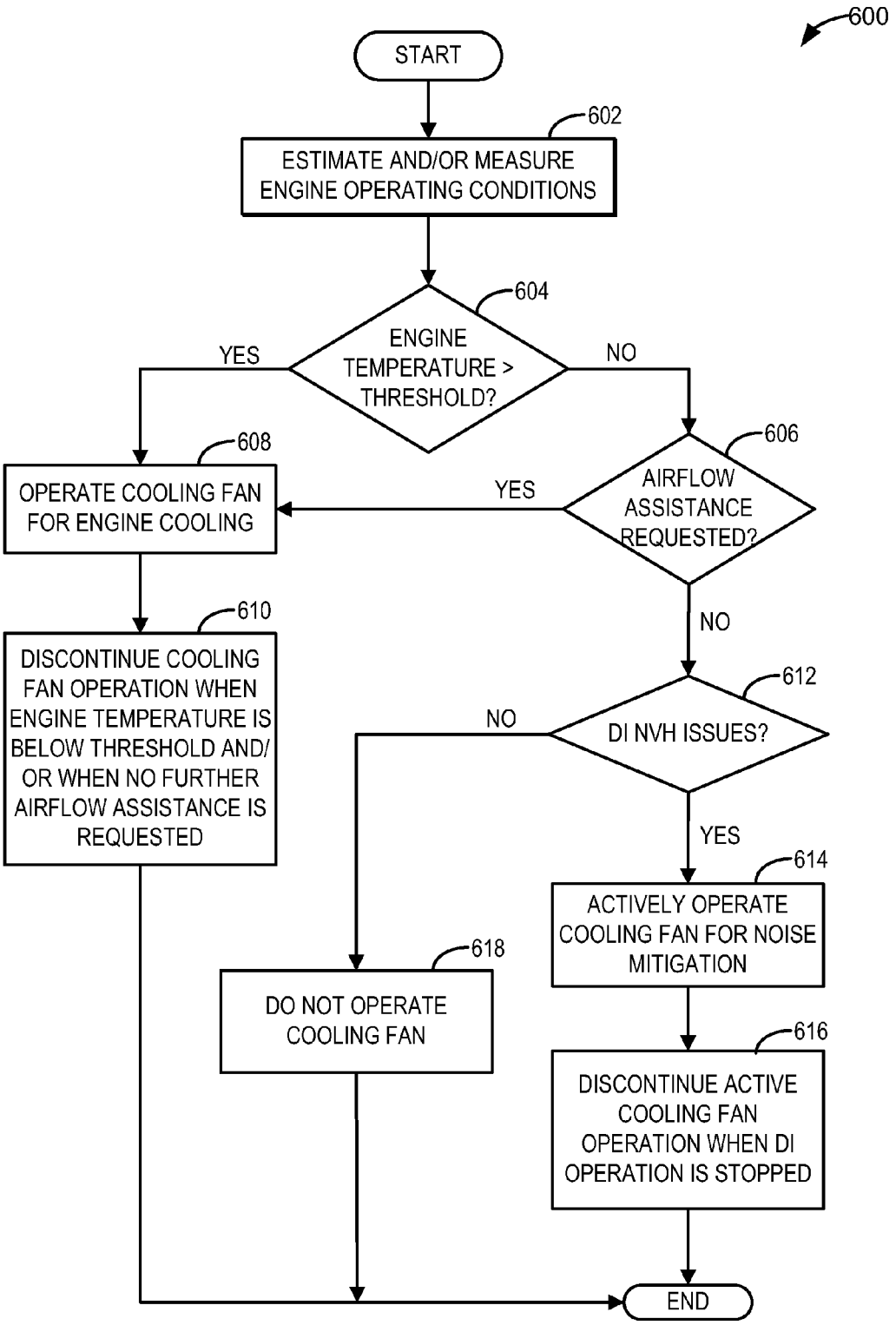
FIG. 6 shows an example method for operating an engine cooling fan based on engine cooling requirements and noise mitigation requirements.

Turning to FIG. 6, a flow chart illustrating an example method 600 for operating the engine cooling fan based on noise mitigation is shown. The operation of the engine cooling fan for noise mitigation occurs during selected conditions where the engine cooling fan may not be normally operated. This allows the engine cooling fan to be actively operated in response to direct injection of fuel, for example during a warm idle condition when the engine temperature is below a threshold temperature, masking NVH from the direct injection system, as described previously in FIGS. 3-5.

At 602, the method may estimate and/or measure the engine operating conditions. These may include, for example, vehicle speed, engine speed, engine temperature, engine coolant temperature, etc.

At 604, the method may determine if the engine temperature is below a threshold temperature at which the cooling fan is automatically turned on for engine cooling. If the engine temperature is above the threshold temperature, the method may proceed to 608 and actively operate the cooling fan for engine cooling. The method may discontinue cooling fan operation at 610 when the engine temperature falls below the threshold temperature and/or when no further airflow assistance is requested. The method may then end.

If at 604, the engine temperature is below the threshold temperature, the method may proceed to 606 and determine if airflow assistance is requested. For example, additional airflow assistance may be desired when a coolant temperature exceeds a threshold value, an intake manifold temperature exceeds a threshold, a modeled temperature (exhaust, engine oil, etc.) exceeds a threshold value, etc. and the airflow 216 through the grille 212 does not suffice. If additional airflow assistance is requested, the method may proceed to 608 as described above and operate the cooling fan for engine cooling. The method may discontinue cooling fan operation at 610 when the engine temperature is below the threshold temperature and/or airflow assistance is no longer requested. The method may then end.

If at 606, airflow assistance is not requested, the method may proceed to 612 and determine if direct injector NVH issues are present. If the direct injection system is not being operated, no DI NVH issues are present and the method may proceed to 618 and not operate the cooling fan. The method may then end. For example, during a warm idle, when engine temperature is below a threshold and no airflow assistance is requested, port fuel injection may be used with no direct injection. During this condition, the cooling fan is not operated.

If at 612 it is determined that DI NVH issues are present, the method may proceed to 614 to actively operate the cooling fan for noise mitigation. For example, the direct injection of fuel during a warm idling condition may be performed for declogging of a tip of the direct injector. The cooling fan is not normally operated during conditions where the engine temperature is below a threshold temperature and airflow assistance is not requested. Here, the cooling fan is operated to mitigate noise from the direct injectors and high pressure pump. The active cooling fan is discontinued when direct injection operated is stopped at 616 and noise mitigation during warm idle conditions is no longer needed. For example, the controller may include further instructions for disabling the cooling fan during the warm idling conditions in response to the completion of direct injector tip declogging and transition to port injection of fuel.

Figure 7:
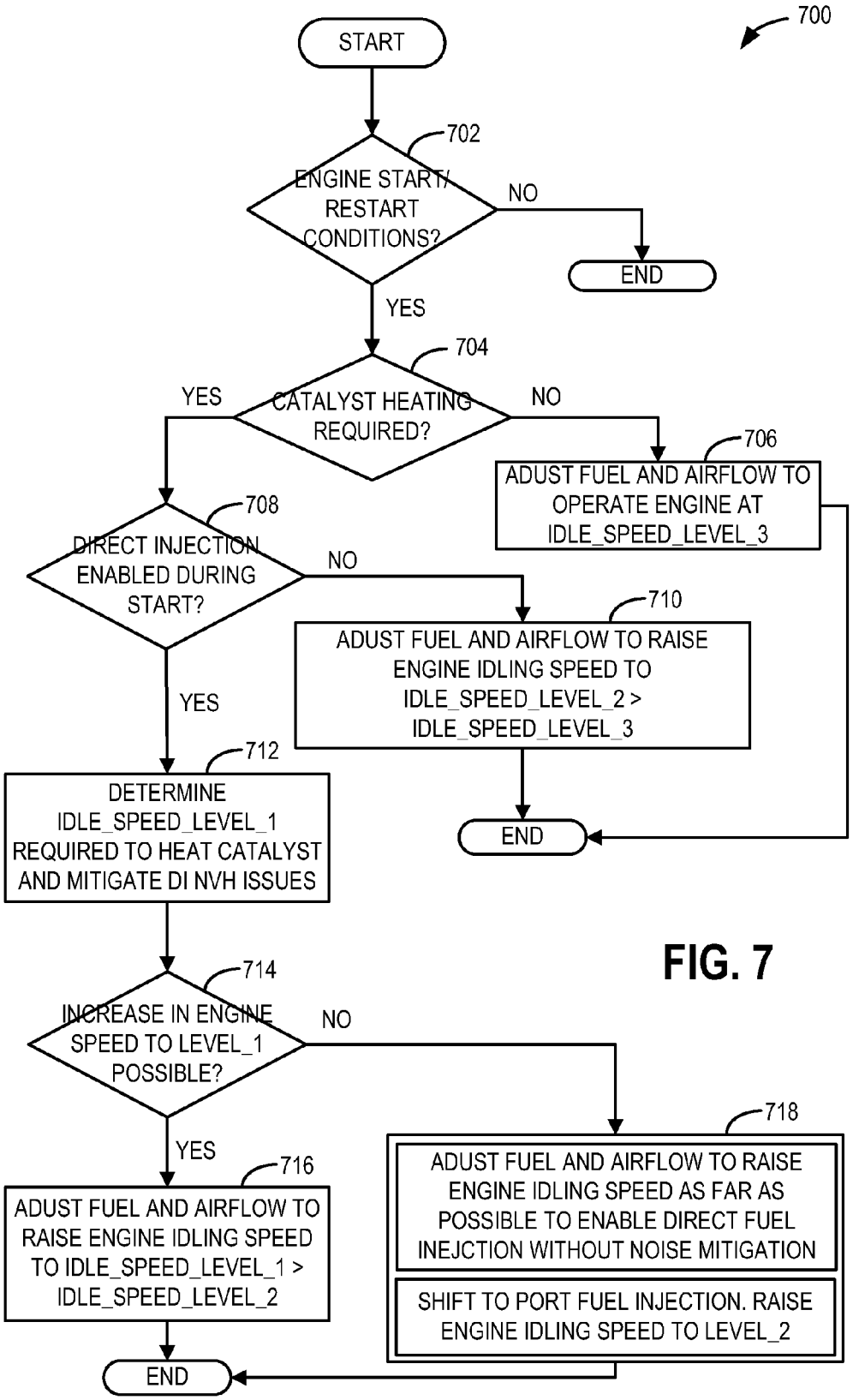
FIG. 7 shows an example method for adjusting engine idling speed based on catalyst heating requirements and noise mitigation requirements.
Figure 8:
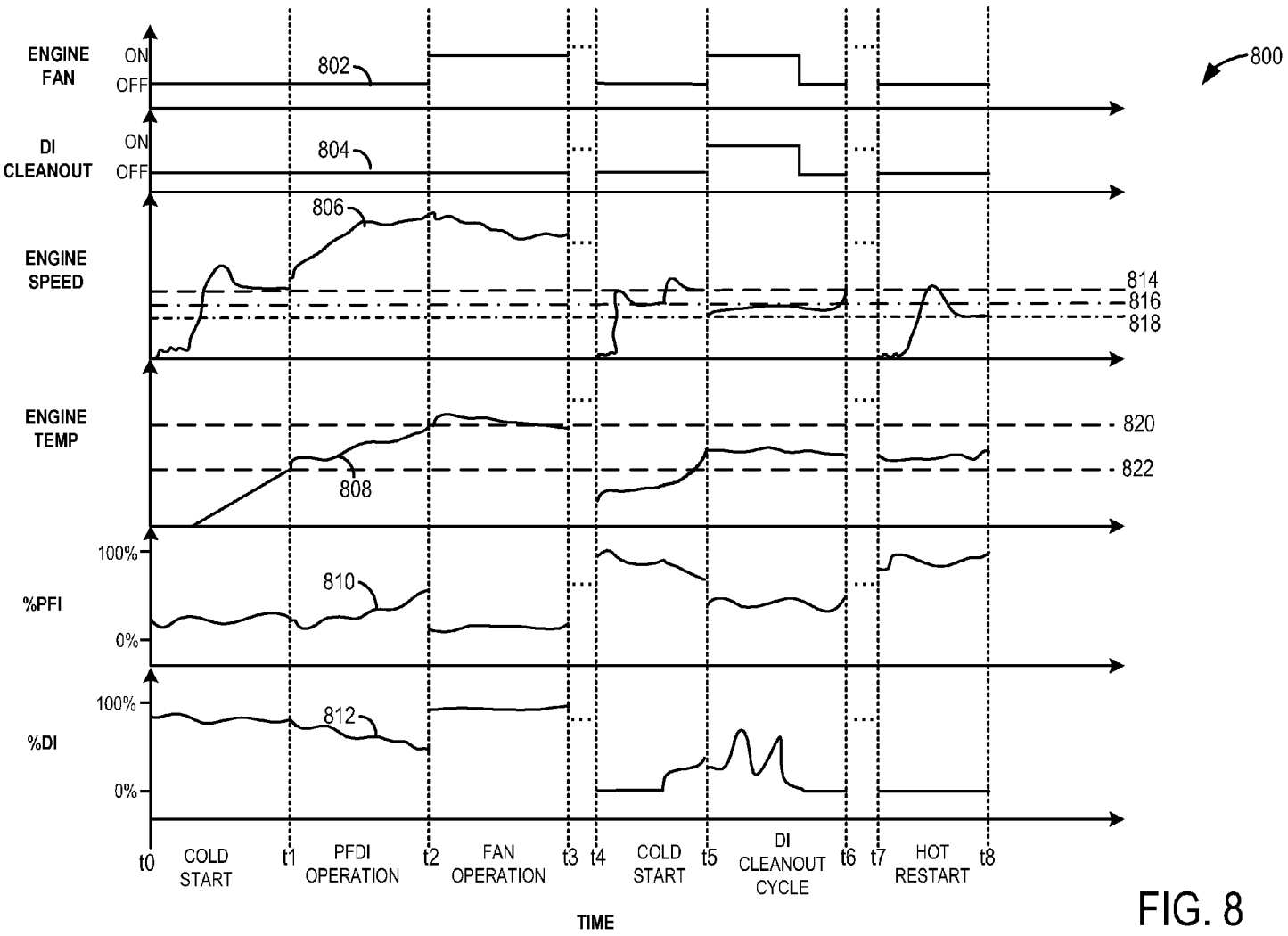
FIG. 8 is a graphical representation of an example timeline for noise mitigation during direct injector operation at certain conditions.

Turning to FIG. 7, an example method 700 for adjusting engine idling speed based on catalyst heating and noise mitigation requirements. The engine idling speed may be controlled to a level where NVH from the direct injection of fuel is masked and/or to raise catalyst temperature above a threshold temperature. The method comprises raising the idling engine speed to above a threshold speed in response to direct injection of fuel, masking NVH from the direct injection system.

At 702, the method may determine if an engine cold-start or a restart condition is present. If no, the method may end. If an engine cold-start or restart condition is present, the method may proceed to 704 and determine whether catalyst heating is required. If no catalyst heating is required, the method may proceed to 706 and adjust the fuel and airflow to operate the engine at third idle speed. For example, at a hot restart condition, the catalyst temperature may be at or within an acceptable threshold difference of the catalyst light-off temperature. Therefore the catalyst would require no heating. The method may then end.

If catalyst heating is required at 704, the method may proceed to 708 and determine if direct injection may be enabled during the engine start condition. If enabling of the direct injection system is not anticipated, the method may proceed to 710 and adjust the fuel and airflow to raise engine idling speed to a second idle speed, which is higher than the third idle speed. For example, during a cold-start where only port injection of fuel is used to raise the catalyst temperature to above the threshold temperature, the idling sped may be raised to the second level. During this condition, no noise mitigation is required since the direct injectors are not enabled.

If the direct injection system is enabled during the start condition at 708, the method may proceed to 712 and determine a first idle speed. The first idle speed may be a level where NVH issues from the direct injection of the fuel is masked as well as being high enough to raise catalyst temperature above a threshold temperature. The first idle speed may be set as a threshold speed which is higher than the engine idling speed used in response to port injection of fuel during an engine cold-start condition, i.e. the second idle speed, illustrated at 710.

At 714, the method may determine if an increase in engine idle speed to the first, higher, idle speed is possible. If yes, the method may proceed to 716 and adjust the fuel and airflow to raise the engine idling speed to the first level, which is higher than the second and third level. The increased idling speed provides noise mitigation during operation of the direct injection system during a cold start, in this example. The method may further comprise, after the catalyst temperature is above the threshold temperature, increasing port injection of fuel based on a combustion event number since the engine start/restart condition. Further, the method may include instruction for the controller for lowering the engine idling speed below the threshold speed during the engine cold-start conditions in response to deactivation of the direct injector during the cold-start. For example, a lower idling speed may improve emissions when the direct injection system is no longer enabled. The method may then end.

At 714, if an increase in engine idling speed to the first level is not possible, the method may proceed to 718. At 718, the method may adjust the fuel and airflow to raise engine idling speed as far as possible in order to enable direct fuel injection without noise mitigation. The method may also shift to port fuel injection and raise the engine idling speed to the second level. In an alternate example, the method may further comprise actively operating the engine cooling fan in response to the at least some direct injection of fuel during the first engine cold-start. This may allow the direct injection system to be enabled during a condition when the engine idling speed is not able to be increased to the first level. The method may then end.

Turning to FIG. 8, an example map 800 is illustrated which shows noise mitigation when the direct injection system is operated under certain engine operating conditions in accordance with the present disclosure. Map 800 outlines various scenarios that may be encountered during engine operation and illustrates instances when noise mitigation, either by increasing an engine idle speed to above a threshold, wherein the engine airflow and/or fuel injection amount is adjusted responsive to measured engine speed to maintain actual engine speed, or operating an engine fan, may be needed. The map illustrates operation of the engine fan 802 as being on or off, the DI system cleanout cycle 804 being on or off, the engine speed 806 (as well as a first higher idle speed 814, a second lower idle speed 816, and a third even lower idle speed 818), the engine temperature 808 (along with a threshold temperature 820 for engine cooling fan operation and a threshold temperature 822 above which the engine is warm), the percentage of PFI 810, and the percentage of DI 812.

During the time period t0 to t1, a first engine cold-start is shown wherein the engine speed 806 is operated at a first higher idle speed 814 while performing direct fuel injection. The engine speed 806 is seen fluctuating during the engine crank and then shows an initial run-up of engine speed before transitioning down to the idle speed. During a cold-start, when the percentage of DI 812 is greater than 0%, a higher idle speed is chosen to mitigate the noise of the DI system. Here, a high percentage of DI is used to assist with catalyst warm up. The percentage of PFI 810 is in the low-mid range. The engine temperature 808 is below the threshold 822 and threshold 820. The engine fan 802 is not operated and the DI cleanout 804 cycle is off.

During the time period t1 to t2, operation of a PFI and DI engine is shown. Here, the engine is warm, as shown by the engine temperature 808 being above threshold 822 but not hot enough to need cooling assistance from the fan, engine temperature 808 below threshold 820. The engine cooling fan 802 is off. The engine speed 806 is seen to increase and then level off, illustrating a period of acceleration. The percentage of DI 812 is seen to start off at a high percent with a low percentage of PFI 810 before transitioning to a higher percentage of PFI, for example in response to a number of combustion events being completed. The DI cleanout 804 cycle is off.

During the time period t2 to t3, operation of the engine cooling fan 802 is shown in response to an engine temperature 808 being above a threshold temperature 820 where additional cooling assistance is needed. The engine speed 806 is seen to be steady. The percentage of DI 812 is increased to take advantage of its charge cooling properties and the percentage of PFI 810 is kept low. The DI cleanout 804 is off. This is an example of operating the engine cooling fan for cooling assistance and not for noise mitigation.

During the time period t3 to t4, the engine is shut-down. During the shut-down, the engine and vehicle components are cooled to ambient temperature.

During the time period t4 to t5, a second engine cold-start is shown wherein PFI 810 only is performed during a duration of the second start. The engine speed 806 is at a second lower idle speed 816 while PFI is performed. The engine temperature 808 is below the threshold 820 and increasing slowly. Following the second engine start, the direct fuel injection 812 is transitioned to a higher percentage. As this happens, the engine speed is increased to the first higher idle speed 814. This may be done when the temperature differential between the catalyst temperature and the light off temperature is greater than a threshold difference for a time period and DI is needed in order to warm up the catalyst quicker. The engine cooling fan 802 is off and the DI cleanout cycle 804 is off. The engine temperature 808 is seen to rise after initiation of the DI system.

During the time period t5 to t6, enough time has passed to initiate the engine DI cleanout 804 cycle, the engine temperature 808 is between thresholds 820 and 822 and the engine speed 806 is steady and at an idle. The PFI 810 is in the mid-range and is normally run during a warm idle to decrease emissions. The DI 812 is run according the cleanout cycle method. During the period of time that the DI system is operated, the engine cooling fan 802 is turned on. As soon as the DI cleanout cycle is done, the engine cooling fan 802 is turned off. A DI cleanout cycle is run during a warm idle, a condition where the engine cooling fan is normally not operated and may be used to mitigate the noise of the DI system.

During the time period t6 to t7, the engine is shut-down. During the shut-down, the engine and vehicle components are not cooled significantly.

During the time period t7 to t8, a hot restart is shown operating the engine speed 806 at a third even lower idle speed 818. Here, the engine temperature 808 is above threshold 822, indicating the engine and vehicle components are above ambient temperature. During this condition, the percentage of PFI 810 is high and the percentage of DI 812 is 0%. The engine cooling fan 802 and DI cleanout 804 are both off. This illustrates a restart condition where the engine is at an idle speed with no DI operation and the catalyst temperature may be at the light off temperature, therefore no noise mitigation is needed.

In this way, existing engine components may be used to provide noise mitigation of a direct injection system under selected operating conditions. This allows for a reduction in the noise, vibration, and harshness hardware currently being employed, which may free up space and reduce costs. By actively operating an engine cooling fan during conditions when engine cooling or airflow assistance is not required, and by synchronizing the operation of the cooling fan with operation of a direct injection system, the objectionable ticking sound of the direct injection components may be masked with the acceptable noise of the cooling fan. By also raising engine speed during direct injection operation, noise mitigation and catalyst heating can be concurrently and synergistically achieved. Overall, the drive experience of a vehicle occupant is improved.

Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

during a first engine cold start, operating at a first higher idle speed while performing direct fuel injection;

during a second engine cold start, operating at a second, lower idle speed while performing only port fuel injection; and during warmed up idle speed operation with an engine temperature below a temperature at which a cooling fan is activated, activating the cooling fan while performing a direct injector cleanout cycle.

2. The method of claim 1, wherein during the first and second engine cold starts, engine and vehicle components are cooled to ambient temperature.

3. The method of claim 1, wherein the engine is coupled to a vehicle and wherein each of the first and second engine cold starts is from engine rest and vehicle at rest.

4. The method of claim 1, wherein engine airflow and/or fuel injection amount is adjusted responsive to measured engine speed to maintain actual engine speed at the first idle speed and second idle speed during the first and second engine cold starts, respectively.

5. The method of claim 4, wherein during a duration of the first engine cold start, only direct fuel injection is performed to all engine cylinders.

6. The method of claim 1, further comprising during a hot engine restart, operating at a third, idle speed lower than each of the first and second idle speeds.

7. The method of claim 6, further comprising, following the first engine cold start, transitioning to port fuel injection in response to a number of combustion events; and following the second engine cold start, transitioning to direct fuel injection in response to a catalyst temperature below a threshold.

8. The method of claim 6, further comprising performing only port fuel injection during a duration of the second engine cold start.

9. The method of claim 1, further comprising disabling the cooling fan during the warmed up idle speed operation in response to one of completion of the direct injector cleanout cycle and a transition to port injection of fuel.

* * * * *